United States Patent [19]

Larsen

[11] Patent Number: 4,525,954

[45] Date of Patent: Jul. 2, 1985

[54] DRIVE MECHANISM FOR A LAPPING MACHINE OR THE LIKE

[76] Inventor: Erik A. Larsen, 2516 14th Ave. West, Suite 303, Seattle, Wash. 98119

[21] Appl. No.: 533,133

[22] Filed: Sep. 15, 1983

[51] Int. Cl.[3] ..... B24B 5/16

[52] U.S. Cl. ..... 51/58; 51/123 R; 74/110

[58] Field of Search ..... 51/123 R, 284, 58; 74/110

[56] References Cited

U.S. PATENT DOCUMENTS

| | | | |
|---|---|---|---|
| 2,082,334 | 6/1937 | Harcourt | 74/110 |
| 2,203,695 | 6/1940 | Murphy | 51/58 |
| 2,693,708 | 11/1954 | Baer | 74/110 |
| 3,037,331 | 6/1962 | Dipprey | 51/123 R |
| 3,169,350 | 2/1965 | Corman | 51/58 |

*Primary Examiner*—Harold D. Whitehead
*Attorney, Agent, or Firm*—Delbert J. Barnard

[57] ABSTRACT

A variable speed elecric motor (74) drives a crank (78) which in turn pushes a push arm (82) against a pivotally mounted drive lever (58), for swinging it through a drive stroke, and then retracting the push arm (82) to allow a spring (72) to return the drive lever (58) through a return stoke. The spring (72) moves the drive lever (58) towards a guide member (92) which is adjustable in position for changing the amplitude of the stroke. The moving end of the drive lever (58) is attached to a drive bar (48) which in turn is attached to and drives a plurality of pin assemblies (44) which serve to locate and drive oscillating members (114) which contact one surface of a lens (116). The opposite surface of the lens (116) is in contact with rotating tool (112) supported on a variable speed spindle (10). The lens (116) is attached to one of the tools (112, 114) and a polishing compound is located between the lens (116) and a surface of the other tool. The drive pins (44) are carried by support arms (46) which are clamped (126) onto the reciprocating drive rod (48).

25 Claims, 12 Drawing Figures

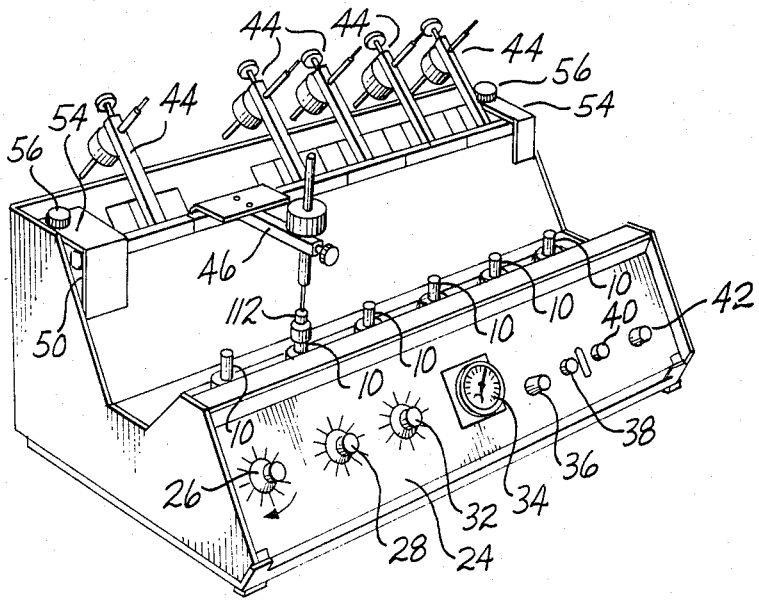
Fig. 1
Fig. 2
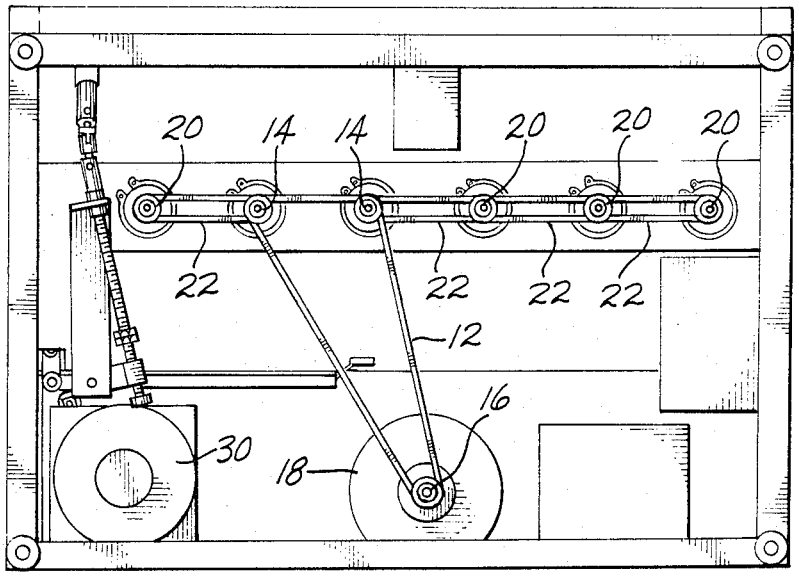

Fig. 4
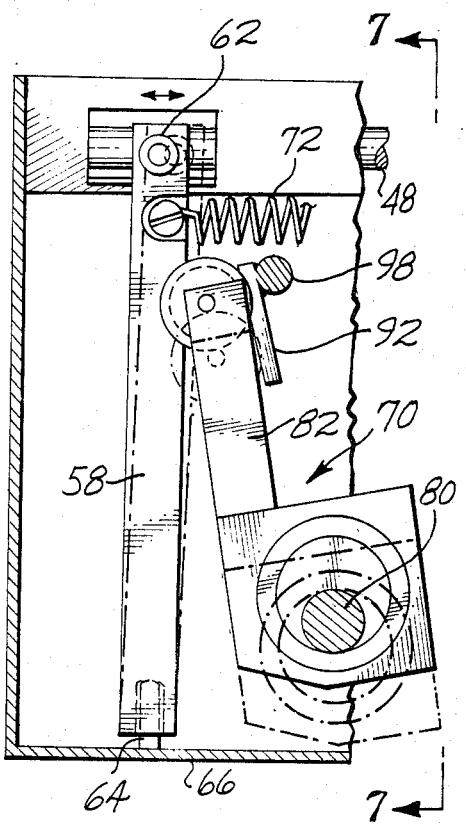
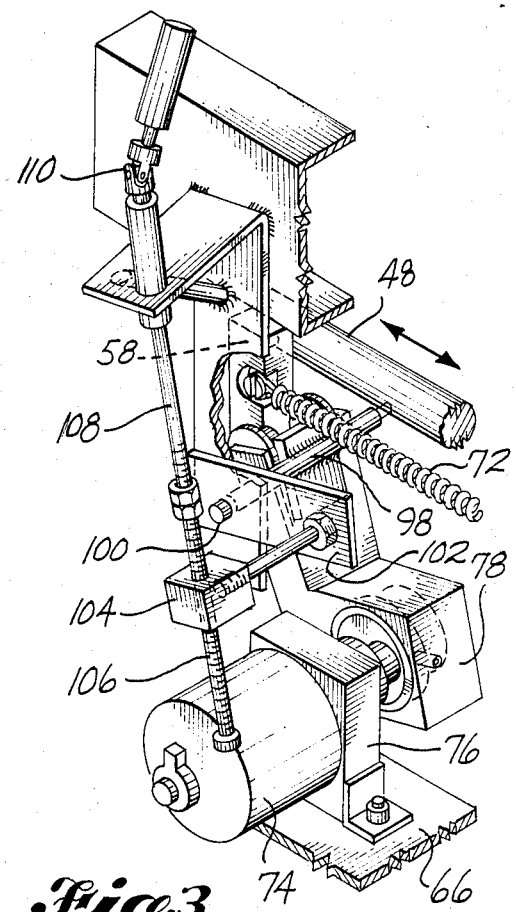
Fig. 3
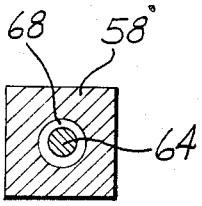
Fig. 6
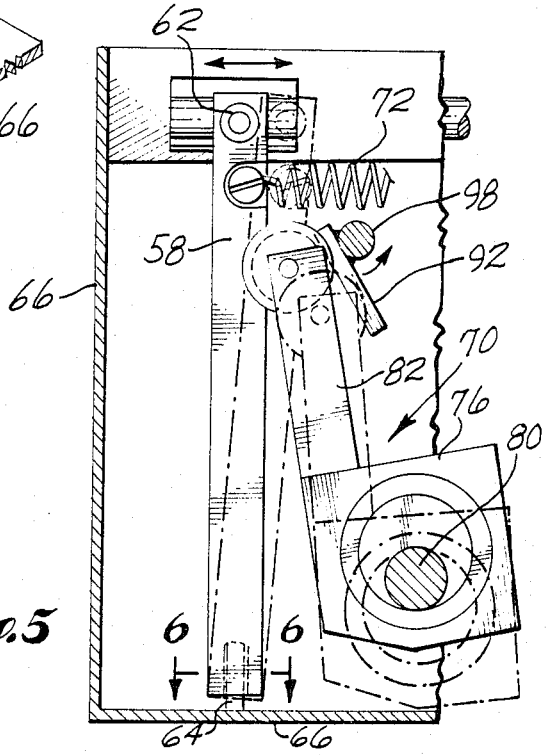
Fig. 5

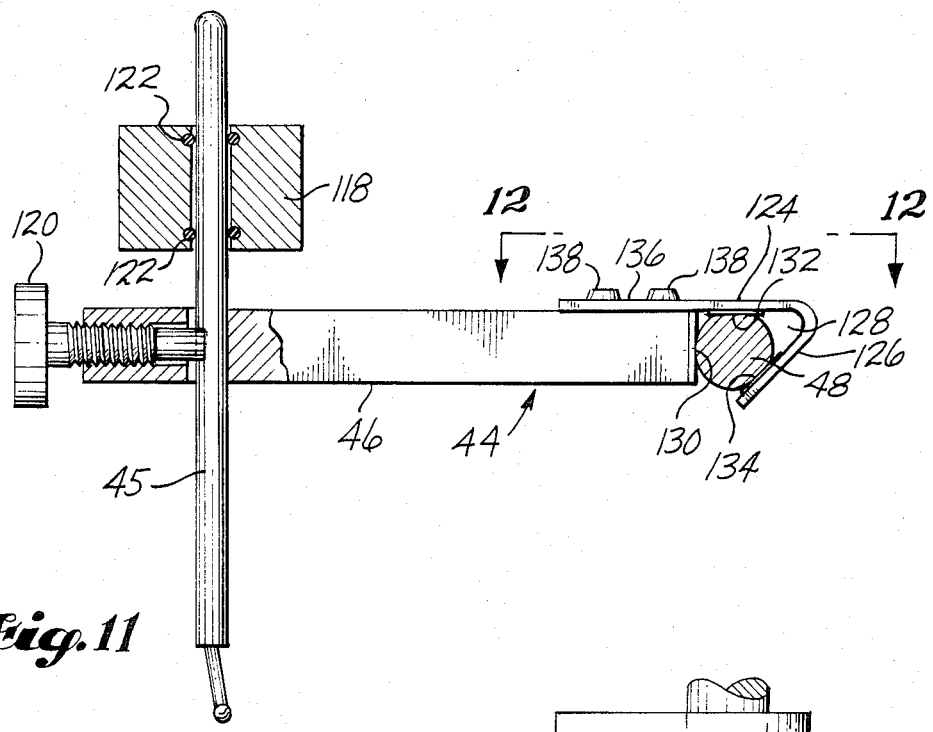
Fig. 11
Fig. 12
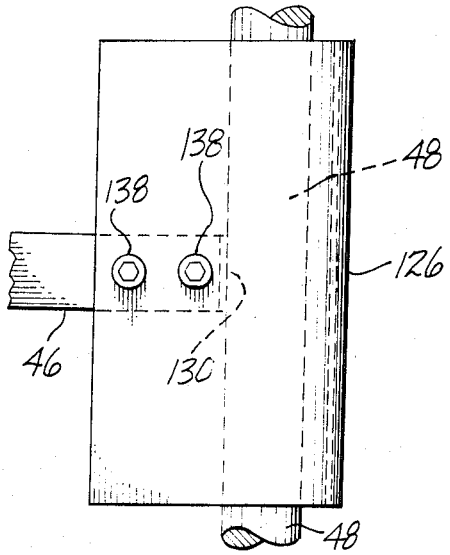

DRIVE MECHANISM FOR A LAPPING MACHINE OR THE LIKE

DESCRIPTION

TECHNICAL FIELD

This invention relates to a mechanical transmission for converting rotary motion to reciprocating translation, and more particularly to the provision of such a mechanism which is adapted to be easily adjustable during operation to change the output speed and/or amplitude, and which is especially adapted for use in a machine for polishing plastic contact lenses, or the like.

BACKGROUND ART

U.S. Pat. No. 3,037,331, granted to James C. Dipprey and Jesse J. Sandifer, on June 5, 1962, and U.S. Pat. No. 3,118,255, granted on the same inventors, on Jan. 21, 1964, each disclose an optical lens polishing machine of a type in which a lens to be polished is positioned between the upper end of a rotating spindle and the lower end of an oscillating pad. The lens is secured to one of these members by means of pitch or the like and a polishing compound is introduced between the other member and the opposite surface of the lens. The present invention was made while working to provide an improved mechanism for oscillating the oscillating pad in a machine of the general type disclosed by U.S. Pat. Nos. 3,037,331, and 3,118,225.

The following United States Patents disclose additional known mechanisms for polishing lenses or other articles: U.S. Pat. Nos. 1,881,982, granted Oct. 11, 1932, to William R. Uhlemann; 3,203,138, granted Aug. 31, 1965, to Thomas L. Ford; 3,225,497, granted Dec. 28, 1965, to Milo O. Brandt; 3,258,879, granted July 5, 1966, to Carlyle A. Edelstein; 3,534,506, granted Oct. 20, 1970, to William Soong et al; 3,739,534, granted June 19, 1973, to Walter A. Schlotfeldt; 3,574,977, granted Apr. 13, 1971, to John D. Spragg; 3,782,042, granted Jan. 1, 1974, to Ray H. Strasbaugh; 4,038,783, granted Aug. 2, 1977, to Leon Rosenthal; and 4,216,626, granted Aug. 12, 1980, to Franz Starp.

These patents should be carefully considered for the purpose of putting the present invention into proper perspective relative to the prior art.

DISCLOSURE OF THE INVENTION

The basic mechanism of this invention comprises a drive lever which extends at an angle to a drive rod which is to be reciprocated along its longitudinal axis. The drive lever includes a first end which is pivotally connected to the drive rod and a second end which is pivotally mounted in a manner permitting the drive lever to swing back and forth about its second end, within the plane of movement of the drive rod. A power push means contacts the drive lever an is operable to swing the drive lever in one direction through a drive stroke. A spring returns the drive lever in the opposite direction through a return stroke.

In accordance with an aspect of the invention, the drive rod is connected to drive pins which are in turn connected to oscillating members, such as the type used in lens polishing machines. Endwise reciprocating of the drive rod operates through a connection with the drive pins to oscillate the oscillating members.

In accordance with another aspect of the invention, the push means comprises a rotary motor and a push arm having a first end in contact with the swing lever.

A drive crank which is driven by the motor is connected to the second end of the push arm. Rotation of the motor causes the push arm to alternatively move against the swing lever, to drive the swing lever through its drive stroke, and then retract from the swing lever, to allow the spring to return the drive lever through its return stroke.

In accordance with another aspect of the invention, the motor is a variable speed motor.

In accordance with yet another aspect of the invention, a push arm guide member is spaced from the drive lever and the push arm travels in a space between the drive lever and the guide member. The guide member is movable in position to in that manner adjust the amplitude of the swing stroke of the drive lever, and in turn the reciprocating movement stroke of the drive rod.

In preferred form, the guide member is attached to a rotatable shaft and the machine includes means for rotating said shaft to in that manner adjust the angular position of the guide member. Preferably also, the push arm includes a roller at its first end which makes rolling contact with the drive lever. It also includes a pair of independently rotatable wheels, one positioned outwardly of each end of the roller. The wheels make rolling contact with the guide member. The drive lever is restrained axially by the two wheels. The guide member may be restrained between flanges carried by the two wheels.

In preferred form, the guide member is attached to a rotatable shaft. A control arm is also connected to the rotatable shaft and projects radially outwardly from it. A lead screw block is secured to the control arm at a location spaced radially outwardly from the shaft. A lead screw engages a threaded opening within the lead screw block and a control shaft is connected to the lead screw. Rotation of the control shaft rotates the lead screw and rotation of the lead screw causes the lead screw block to travel relatively along the lead screw. This movement of the lead screw block causes an angular movement of the control arm, and such angular movement of the control arm rotates the rotatable shaft to adjust the position of the guide member to in this manner adjust the amplitude of swing movement of the drive lever, and in turn the amplitude of travel of the drive rod.

In preferred form, the speed of movement of the reciprocating drive rod is easily adjusted by adjusting the rotational speed of the motor. The amplitude of travel of the reciprocating drive rod is easily adjusted by a simple rotation of the control shaft. Both adjustments can be made while the machine is operating.

BRIEF DESCRIPTION OF THE DRAWINGS

In the drawings, like reference numerals are used to designate like parts, and:

FIG. 1 is a pictorial view taken from above and looking towards the front and one end of a plastic contact lens polishing machine which embodies the present invention, such view showing one of the drive pin assemblies mated with its spindle, with a contact lens between them, and the other drive pin assemblies moved up into inactive positions;

FIG. 2 is a bottom plan view of the machine, showing a belt drive system for the spindles and the relative position of the drive mechanism of the present invention with respect to the other parts of the machine;

FIG. 3 is a pictorial view of an embodiment of the invention, looking towards the side of the mechanism which is directed downwardly when incorporated in the machine shown by FIGS. 1 and 2;

FIG. 4 is a bottom plan view of the mechanism shown by FIG. 3, with the guide member positioned to provide a small stroke of the drive rod;

FIG. 5 is a view like FIG. 4, but with the guide member adjusted in position to provide a larger stroke of the drive rod;

FIG. 6 is a sectional view taken substantially along line 6—6 of FIG. 5;

FIG. 11 is a side elevational view of one of the drive pin assemblies, with some parts shown in section; and FIG. 12 is a fragmentary top plan view of the inner end of a support arm portion of the drive pin assembly, showing the manner in which such support arm is secured to the reciprocating drive rod.

BEST MODE FOR CARRYING OUT THE INVENTION

Figure 7:
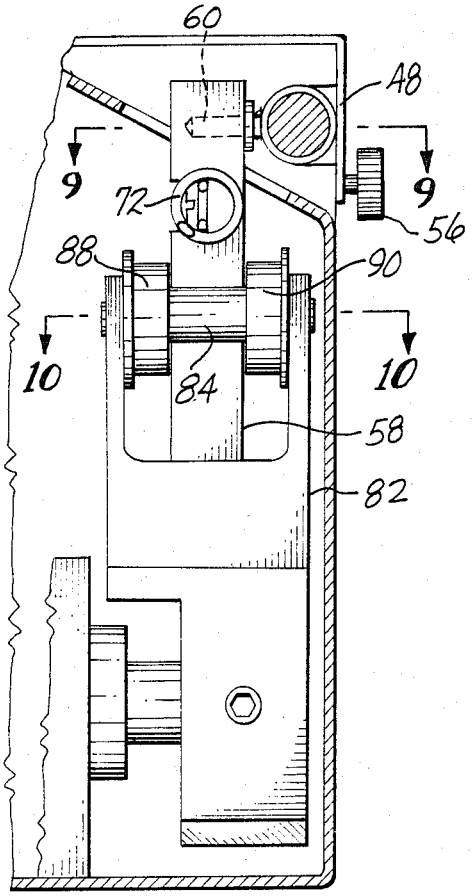
FIG. 7 is an elevational view of the mechanism shown by FIGS. 3–5, taken generally from the position indicated by line 7—7 in FIG. 4.

The illustrated embodiment is a lens polishing machine which includes an embodiment of the invention. Referring to FIG. 1, the machine comprises a plurality of rotating spindles 10 which are mounted in bearings for rotation about vertical axes. The spindles 10 are driven from their lower ends, by means of a belt and pulley drive system. Referring to FIG. 2, this system may comprise a drive belt 12 which extends over two pulleys 14, secured to lower end portions of a pair of adjacent spindles 10, and a pulley 16 secured to the output shaft of a variable speed dc motor 18. Belt 12 drives the two pulleys 14. This drive is transmitted to pulleys 20 at the lower ends of the other spindles by means of a plurality of smaller drive belts 22. As is well known, the pulleys 14 and some of the pulleys 20 are adapted to engage a pair of side-by-side positioned belts.

Referring again to FIG. 1, the lens polishing machine is shown to include a control panel 24. By way of typical and therefore nonlimitative example, the arrangement of the control devices on the control panel 24 may start at the left end of the machine with a rotary control knob 26, the function of which is hereinafter described. The next control 28 is a rotary control knob for controlling the output speed of a variable speed dc motor 30 which is yet to be described. Knob 32 is a rotatable control knob for adjusting the output speed of variable speed dc motor 18. In other words, rotation of knob 32 controls the speed of rotation of the spindles 10.

The display portion of a timer is designated 34. A start button 36 is provided for starting a cycle. A main on-off switch is designated 38.

A light 40 is provided to light up when the power is on. A plug-in type of fuse 42 is shown adjacent the light 40.

Each spindle 10 is paired with a drive pin assembly 44. Each drive pin assembly 44 includes a support arm 46 (FIG. 11) the inner end of which is clamped onto or otherwise secured to a reciprocating drive rod 48.

As is best shown by FIG. 1, the opposite ends of the drive rod 48 are set down into upwardly opening saddles 50, provided at the opposite ends of the machine. When the drive rod 48 is in place, the upper ends of the saddles 50 are closed by means of cover plates 54 which are secured by thumb screws 56 which screw down into top portions of the saddles 50.

As best shown by FIGS. 4, 5, 7 and 9, one end of the drive rod 48 is pin connected to the upper end of a drive lever 58. In preferred form, the drive rod 48 includes a laterally projecting pin 60 which extends into a bushing 62 carried by the upper end of the drive lever 58.

Referring to FIGS. 4–6, the lower end of drive lever 58 is mounted to permit drive lever 58 to swing about its lower end, back and forth between opposite limits of a variable, but relatively small angle swing path. The lower end mounting for drive lever 58 may simply comprise a pin 64, connected to the machine housing 66, and an oversized socket 68 formed in the lower end portion of drive lever 58 (FIG. 6).

The drive lever 58 is pushed in one direction, through a drive stroke, by means of a motor driven push mechanism 70, and is returned in the opposite direction, through a return stroke, by a tension spring 72. Spring 72 is connected at one end to the drive lever 58 and at its opposite end to a portion of the machine frame (not shown). Spring 72 serves to normally bias the drive lever 58 towards the push mechanism 70.

The push mechanism comprises a variable speed dc motor 74, shown in FIG. 3 to be mounted by a member 76 to a portion of the machine housing 66. An eccentric or crank drive 78 is provided on the output shaft 80 of motor 74. The crank drive 78 includes a push arm 82, the outer end of which carries a roller 84 (FIGS. 7 and 10) which makes rolling contact with a side surface of the drive lever 58. Roller 84 is mounted for free rotation about a center portion of a shaft 86 (FIG. 10) which also carries a pair of wheels 88, 90, situated at opposite ends of the roller 84. Roller 84 is smaller in diameter than wheels 88, 90. Thus, lever 58 is flanked by outer side portions of the wheels 88, 90, and in this manner lever 58 is retained against movement axially of shaft 86.

Figure 10:
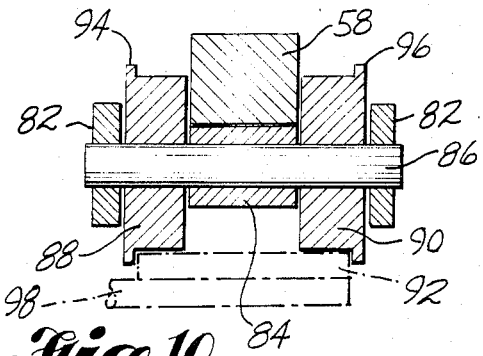
FIG. 10 is a sectional view taken substantially along line 10—10 of FIG. 7.

A guide member 92 is positioned on the side of push arm 82 that is opposite lever 58. In preferred form guide member 92 is a flat plate having side edges. The rim portions of the wheels 88, 90 contact face portions of the plate 92. Preferably, the wheels 88, 90 include flanges 94, 96, between which the plate 92 is restrained (FIG. 10).

The spring tension acting on lever 58 also pulls the push arm 82 towards the guide member 92. Guide member 92 establishes one boundary of the swing stroke of lever 58. In accordance with an aspect of the invention, guide member 92 is adjustable in position, so that the position of this boundary can be changed for the purpose of changing the amplitude of the swing stroke.

Shown by FIGS. 3–5, the guide member 92 is secured to a rotatable control shaft 98. The opposite ends of the control shaft 98 are suitably journaled for rotation. One end 100 of shaft 98 is shown to be connected to an arm 102 which projects radially outwardly from the shaft 98. A lead screw block 104 is suitably mounted onto an outer end portion of control arm 102. A lead screw 106 engages a threaded opening in the lead screw block 104. A control shaft 108 is connected to the lead screw 106. As shown, control shaft 108 may include a universal joint 110. The end of control shaft 108 opposite the lead screw 106 is connected to the aforementioned control knob 26. Rotation of control knob 26 rotates the control shaft 108. Rotation of the control shaft 108 rotates the lead screw 106. Rotation of the lead screw 106 causes the lead screw block to travel relatively along the lead screw 106. This movement of the lead screw block 104 causes an angular movement of the control arm 102. This angular movement of the control arm 102 causes shaft 98 to rotate and this in turn changes the angular position of guide member 92.

As shown by FIGS. 4 and 5, the end of the push arm 82 opposite the crank drive 76, i.e. the end carrying the roller 84 and the wheels 88, 90 is trapped between the drive lever 58 and the guide member 92. Rotation of the motor shaft 80 operates the crank and the crank functions to first push the push arm 82 towards the drive lever in a direction opposing the pull of spring 72, to drive the drive lever 58 through its drive stroke, and then retract the push arm 82 away from the drive lever 58, to allow the spring 72 to return the drive lever through its return stroke. As a comparison of FIGS. 4 and 5 show, angular rotation of guide member 92 towards drive lever 58 will decrease the stroke length or amplitude of lever 58. Rotation of guide member 92 away from a drive lever 58 will increase the stroke length or amplitude of drive lever 58.

Both the speed control of the drive, effected by rotation of control knob 28, and the amplitude of movement, controlled by rotation of control knob 26, can be performed while the machine is operating.

Figure 8:
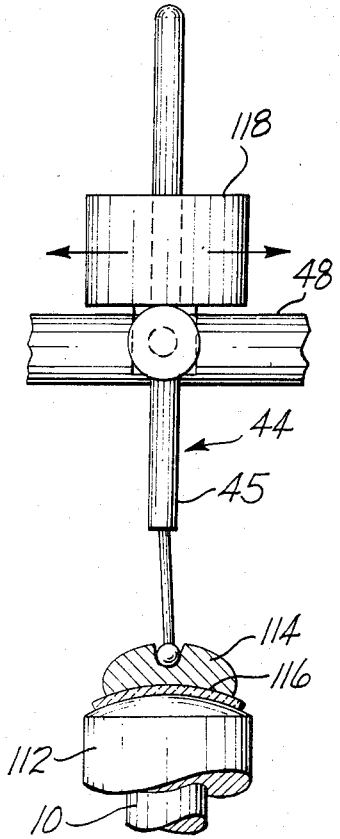
FIG. 8 is a front elevational view of a drive pin assembly.
Figure 9:
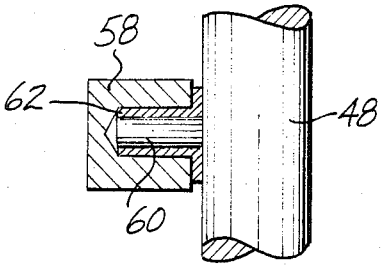
FIG. 9 is a sectional view taken substantially along line 9—9 of FIG. 7.

Referring to FIG. 8, when a particular station of the machine is to be used, a first tool member 112 is secured to the upper end of the spindle 10 at such station. A second tool member 114 is inserted on to the lower end of the pin 45. If the lower surface of the lens or workpiece 116 is to be polished, the member 114 is a support pad and the member 112 is a lap. The lens 116 is temporarily secured to the support pad 114, such as by the use of a pitch which is available for this purpose. A suitable polishing compound is placed on the upper surface of the lap 112. Then, the drive pin assembly is swung downwardly so that the lens 116 carried by the support pad 114 makes contact with the polishing compound. Then, the machine is turned on and operated for a set amount of time, for the purpose of finishing the lower surface of the lens 116. The pin assembly includes a weight 118 which is chosen to provide the proper amount of force on the lens 116.

During the polishing operation, the spindle 10 and the lap 112 carried thereby rotate about a vertical axis. The drive rod 48 reciprocates back and forth along its axis, and this movement causes the pad 114 to oscillate in position.

It was found by use of the mechanism of the present invention for driving the drive rod 48, a smooth but random oscillating movement was obtained. In other words, the oscillations were smooth and not jerky, but the pattern of oscillation appeared to continue to change. Random oscillation means that the end positions of the strokes vary. This phenomenon appeared to speed up the polishing operation, so that less time was required to perform each polishing operation.

As is well known in the lens polishing art, if it is desired to finish the opposite surface of the contact lens 116, the member 112 is a support head and the member 114 is a lap. The pitch is used to secure the lens 116 to the support head 112 and the polishing compound is placed between the lap 114 and the upper surface of the lens 116. In other respects, operation of the machine is the same.

Referring now to FIGS. 11 and 12, the pin 45 is endwise adjustable in position relative to the support arm 46. It is held into any given position by means of a thumb screw 120. The weight 118 may include a pair of O-rings 122 which makes a frictional grip with the pin 45. Thus, weight 118 can be slid lengthwise of pin 45 and it will stay in any given position in which it is set.

According to an aspect of the invention, the inner end of each support arm 46 is adjustably clamped to the drive rod 48. The clamp mechanism may simply comprise a rectangular piece of sheet metal 124 which has been bent back on its self at 126. Thus, the two parts of each member 124 defines an angular nook region 128 in which a portion of the drive rod 48 is received. A first teflon pad 130 is provided at the inner end surface of support arm 46. Additional teflon pads 132 and 134 are provided where member 124 makes contact with the drive rod 48. A shank portion 136 of member 124 is secured to the inner end portion of support arm 46, such as by means of a pair of large head screws 138. The holes in the shank 136 are larger in diameter than the shaft diameter of the screws 138, to provide an easy way of adjusting the member 124 in position relative to the support arm 46.

To assemble, the hook portion 128 is placed around the drive rod 48. Then, the shank 136 is placed over the inner end portion of support arm 46 and the large head screws 138 are set into place. Then, the member 124 is adjusted in position lengthwise of drive rod 48 and then the support arm 46 and the member 124 are pushed together, so as to make tight engagement with the drive rod 48. Then, the screws 138 are tightened. The head portions of the screws 138 bear against surface portions of the shank 136 and serve to firmly secure the member 124 in position relative to support arm 46. From time to time, due to wear at the contact pads 130, 132, 134, or for some other reason the connection of the arm 46 to the drive rod 48 becomes loose. When this happens, the screws 138 can be loosened, the elements 46, 124, can be moved into tighter contact with drive rod 48, followed by a tightening of the screws 138. It has been found that a loose connection between a support arm 46 and the drive rod 48 results in a rough motion at the lens, affecting the quality of the polishing operation.

It is believed that the mechanism of the present invention, for changing a variable speed rotary drive into a variable speed and variable amplitude reciprocating translation drive, may have application in other types of machines. Also, various component detail, and relative arrangements of the components, may vary from one installation to another. Accordingly, the example that has been illustrated and described is merely provided by way of example, but constitutes the best mode of the invention, and further fulfills the enabling requirements of the patent laws, but is not to be used to directly define or limit the invention. The invention and coverage is to be defined by and is to be determined solely from the appended claims.

What is claimed is:

1. A lens polishing machine, comprising:

a rotating member having a workpiece engaging end;

an oscillating member having a workpiece engaging end, wherein in use a workpiece is secured to one of the members and the other carries a polishing or grinding compound;

means for oscillating said oscillating member including:

an endwise reciprocating drive rod to which said oscillating member is connected, which when reciprocated, causes the oscillating member to oscillate;

a drive lever extending at an angle to said drive rod having a first end pivotally connected to the drive rod and a second end pivotally mounted in a manner permitting the drive lever to swing back and forth about said second end, within the plane of movement of the drive rod; and drive means for swinging the drive lever back and forth, including power push means contacting the drive lever and operable to swing the drive lever in one direction through a drive stroke, and spring means for returning the drive lever in the opposite direction through a return stroke.

2. A machine according to claim 1, wherein said power push means comprises a rotary motor, a push arm having a first end in contact with the drive lever and a second end, and a crank drive connected to the motor and to the second end of the push arm and operable during rotation of the motor to move the push arm against the drive lever in a direction opposing the spring force, to drive the drive lever through its drive stroke, and then retract the push arm away from the drive lever, to allow the spring means to return the drive lever through its return stroke.

3. A machine according to claim 2, wherein the motor is a variable speed motor.

4. A machine according to claim 2, wherein said push arm includes a roller at its first end in rolling contact with the drive lever.

5. A machine according to claim 4, further including means at each end of the roller occupying positions immediatley outboard of opposite side portions of the drive lever.

6. A machine according to claim 5, further comprising a push arm guide member spaced from the drive lever, and wherein the push arm travels in a space between the drive lever and the guide member, and wherein the means at each end of the roller is a wheel in contact with the guide member.

7. A machine according to claim 4, wherein each wheel includes an outer edge flange which occupies a position immediately outboard of a near edge of the guide member.

8. A machine according to claim 6, wherein the guide member is movable in position to in that manner adjust the amplitude of the swing stroke of the drive lever and in turn the reciprocating movement stroke of the drive rod and the amplitude of oscillation of the oscillating member.

9. A machine according to claim 8, wherein said guide member is attached to a rotatable shaft and the machine includes means for rotating said shaft to in that manner adjust the angular position of the guide member.

10. A machine according to claim 9, wherein a control arm is connected to said rotatable shaft and projects radially therefrom, a lead screw block is secured to the control arm at a location spaced radially outwardly from the shaft, a lead screw engages a threaded opening within the lead screw block, and a control shaft is connected to the lead screw, whereby rotation of the control shaft will rotate the lead screw and rotation of the lead screw will cause the lead screw block to travel relatively along the lead screw, and such movement of the lead screw block will cause an angular movement of the control arm, and such angular movement of the control arm will rotate the rotatable shaft and the guide member secured thereto.

11. A machine according to claim 2, further comprising a push arm guide member spaced from the drive lever, and wherein the push arm travels in a space between the drive lever and the guide member, with the first end of the push arm in contact with both the drive lever and the guide member.

12. A machine according to claim 11, wherein the guide member is movable in position to in that manner adjust the amplitude of the swing stroke of the drive lever and in turn the reciprocating movement stroke of the drive rod and the amplitude of oscillation of the oscillating member.

13. A machine according to claim 12, wherein said guide member is attached to a rotatable shaft and the machine includes means for rotating said shaft to in that manner adjust the position of the guide member.

14. A machine according to claim 13, wherein a control arm is connected to said rotatable shaft and projects radially therefrom, a lead screw block is secured to the control arm at a location spaced radially outwardly from the shaft, a lead screw engages a threaded opening with the lead screw block, and a control shaft is connected to the lead screw, whereby rotation of the control shaft will rotate the lead screw and rotation of the lead screw will cause the lead screw block to travel relatively along the lead screw, and such movement to the lead screw block will cause an angular movement of the control arm, and such angular movement of the control arm will rotate the rotatable shaft and the guide member secured thereto.

15. A polishing machine according to claim 1, wherein said second end is pivotally mounted to a support in a manner so that said second end oscillates in the same plane of movement as said drive rod when said drive rod swings back and forth about said second end.

16. A polishing machine according to claim 15, including a pin connected to said support, and wherein said second end of said drive lever includes a socket, said socket receiving said pin, and further, said socket being sized larger than said pin so that said second end may both pivot and oscillate back and forth relative to said support in the same plane of movement as said drive rod.

17. For use in a machine having an endwise reciprocating drive rod, a mechanism for reciprocating said drive rod comprising:

a drive lever extending at an angle to said drive rod and having a first end pivotally connected to the drive rod and a second end pivotally mounted in a manner permitting the drive lever to swing back and forth about said second end, within the plane of movement of the drive rod; and drive means for swinging the drive lever back and forth, including power push means contacting the drive lever and operable to swing the drive lever in one direction through a drive stroke, and spring means for returning the drive lever in the opposite direction through a return stroke;

wherein said power push means comprises a rotary motor, a push arm having a first end in contact with the drive lever and a second end, and a crank drive connected to the motor and to the second end of the push arm and operable during rotation of the motor to move the push arm against the drive lever in a direction opposing the spring force, to drive the drive lever through its drive stroke, and then retract the push arm away from the drive lever, to allow the spring means to return the drive lever through its return stroke.

18. A machine according to claim 17, comprising a variable speed motor.

19. A machine according to claim 17, further comprising a push arm guide member spaced from the drive lever, and wherein the push arm travels in the space the drive lever and the guide member.

20. A machine according to claim 19, wherein the guide member is movable in position to in that manner adjust the amplitude of the swing stroke of the drive lever and in turn the reciprocating movement stroke of the drive rod.

21. A machine according to claim 20, wherein said guide member is attached to a rotatable shaft and the machine includes means for rotating said shaft to in that manner adjust the position of the guide member.

22. For use in a machine having an endwise reciprocating drive rod, a mechanism for reciprocating said drive rod comprising:

a drive lever extending at an angle to said drive rod and having a first end pivotally connected to the drive rod and a second end pivotally mounted to a support in a manner permitting the drive lever to swing back and forth about said second end, within the plane of movement of the drive rod, and drive means for swinging the drive means back and forth, including power push means contacting the drive lever and operable to swing the drive lever in one direction through a drive stroke, and spring means for returning the drive lever in the opposite direction through a return stroke, said power push means comprising a rotary motor, with said motor being a variable speed motor, and a push arm having a first end in contact with the drive lever and a second end, and a crank drive connected to the motor and to the second end of the push arm and operable during rotation of the motor to move the push arm against the drive lever in a direction opposing the spring force, to drive the drive lever through its drive stroke, and then retract the push arm away from the drive lever, to allow the spring means to return the drive lever through its return stroke, and including a push arm guide member spaced from the drive lever, and wherein the push arm travels in the space between the drive lever and the guide member, wherein the guide member is movable in position to in that manner adjust the amplitude of the swing stroke of the drive lever and in turn the reciprocating movement stroke of the drive rod, and wherein said guide member is attached to a rotatable shaft, and wherein a control arm is connected to said rotatable shaft and projects radially therefrom, a lead screw block is secured to the control arm at a location spaced radially outwardly from the shaft, a lead screw engages a threaded opening within the lead screw block, and a control shaft is connected to the lead screw, whereby rotation of the control shaft will rotate the lead screw and rotation of the lead screw will cause the lead screw block to travel relatively along the lead screw, and such movement of the lead screw block will cause an angular movement of the control arm, and such angular movement of the control arm will rotate the rotatable shaft and the guide member secured thereto.

23. A polishing machine comprising:

a rotating member having a workpiece engaging end;

an oscillating member having a workpiece engaging end, wherein in use a workpiece is secured to one of the members and the other carries a polishing or grinding compound;

means for rotating the rotating member; and means for oscillating said oscillating member including:

an endwise reciprocating drive rod to which said oscillating member is connected, which when reciprocated, causes the oscillating member to oscillate; and means for reciprocating the drive rod along its axis, and wherein the oscillating member further comprises a support arm having an inner end portion and an outer end portion, with said outer end portion supporting both a member having a workpiece engaging end and a weight, and a connector member having a shank portion and an opposite end portion bent back on itself to with said shank portion define an angular nook, means for securing the shank portion of said connector member to the inner end portion of the support arm, with a portion of the drive rod being within said angular nook, and further, with an inner end surface of the support arm being in contact with such drive rod, so that the support arm is secured to the drive rod.

24. A polishing machine according to claim 23, further comprising a grip pad on the end surface of the support arm and additional grip pads carried by the connector member, wherein grip pads contact the drive rod.

25. A polishing machine according to claim 23, comprising means for adjustably connecting the shank portion of the connector member to the inner end portion of the support arm 46, so that the connector member can be adjusted to tighten its clamping grip on the drive rod.

* * * * *